US006321728B1

(12) United States Patent
Ohkuma

(10) Patent No.: US 6,321,728 B1
(45) Date of Patent: Nov. 27, 2001

(54) APPARATUS AND METHOD FOR DIAGNOSING FAULTS OF FUEL VAPOR TREATMENT UNIT

(75) Inventor: Shigeo Ohkuma, Atsugi (JP)

(73) Assignee: Unisia Jecs Corporation, Kanagawa (JP)

( * ) Notice: Subject to any disclaimer, the term of this patent is extended or adjusted under 35 U.S.C. 154(b) by 0 days.

(21) Appl. No.: 09/598,412

(22) Filed: Jun. 21, 2000

(30) Foreign Application Priority Data

Jun. 30, 1999 (JP) ..... 11-185487

(51) Int. Cl.[7] ..... F02M 33/04
(52) U.S. Cl. ..... 123/520
(58) Field of Search ..... 123/516, 518, 123/519, 520

(56) References Cited

U.S. PATENT DOCUMENTS 5,669,362 * 9/1997 Shinohara et al. ..... 123/520
5,679,890 * 10/1997 Shinohara et al. ..... 123/520
6,119,663 * 9/2000 Okuma ..... 123/520

FOREIGN PATENT DOCUMENTS 5-215020 8/1993 (JP) .

* cited by examiner

*Primary Examiner*—Thomas N. Moulis
(74) *Attorney, Agent, or Firm*—McDermott, Will Emery

(57) ABSTRACT

In an apparatus and method where the interior of a fuel vapor treatment unit of an internal combustion engine is closed off and pressurized air is supplied, so that the presence of a leak of fuel vapor is diagnosed based on a change condition of the pressure inside the fuel vapor treatment unit, the construction is such that the diagnosis is permitted on the proviso that a condition for close to engine start time is detected. As a result, the influence of heat from the engine after the engine has stopped, and the influence of vibration due to the road surface when the vehicle is travelling and of atmospheric pressure changes due to differences in altitude can be simultaneously avoided, so that erroneous diagnosis due to these influences can be prevented, and fault diagnosis accuracy thus improved.

23 Claims, 9 Drawing Sheets

APPARATUS AND METHOD FOR DIAGNOSING FAULTS OF FUEL VAPOR TREATMENT UNIT

BACKGROUND OF THE INVENTION

1. Field of the Invention

The present invention relates to technology for diagnosing the presence of faults (fuel vapor leaks) in a fuel vapor treatment unit of an internal combustion engine, and in particular to technology for preventing erroneous diagnosis and increasing diagnosis accuracy.

2. Description of the Related Art

With conventional fuel vapor treatment units for internal combustion engines, diffusion of fuel vapor into the atmosphere is prevented by temporarily adsorbing fuel vapor generated in the fuel tank etc. into an adsorption unit (canister), and then, under predetermined engine operating conditions, de-adsorbing the adsorbed fuel vapor and mixing this with purge air, and drawing the purge mixture into an engine intake system, while controlling the flow of purge mixture with a purge control valve (refer to Japanese Unexamined Patent Publication No. 5-215020).

With the above units however, if a crack occurs along the fuel vapor piping, or a fault occurs in a seal at a fuel vapor piping connection, then the fuel vapor will diffuse into the atmosphere from the leak portion, so that the original diffusion prevention effect cannot be fully realized.

For an apparatus for diagnosing the presence of faults (fuel vapor leaks) in the fuel vapor treatment unit, the following methods have been contemplated.

That is to say, fault diagnosis of a fuel vapor treatment unit is carried out by closing a purge control valve disposed in a purge passage between a canister and an intake passage at the time of diagnosis, being after the engine has stopped or while the vehicle is travelling, then supplying air which is pressurized by a pump device provided for diagnosis, to inside a sealed fuel vapor supply system on the downstream side of the purge control valve, and making a judgement of a pressure rise of the fuel vapor supply system, or a time until a predetermined pressure is reached.

After the engine has stopped however, the quantity of vapor generated inside the fuel tank due to the heat from the engine is comparatively large, and hence this is an unsuitable condition for accurate fault diagnosis. Moreover, when the vehicle is travelling, in addition to the engine heat, there is the likelihood during fault diagnosis of influences due to changes in atmospheric pressure from travelling along roads of different altitudes. Furthermore, the liquid level inside the fuel tank also is agitated due to vibrations from the engine or the road surface, thus becoming a source of erroneous diagnosis.

The present invention takes into consideration such heretofore problems, with the object of being able to prevent erroneous diagnosis in a fuel vapor treatment unit, and thus carry out accurate diagnosis.

Furthermore, without requiring modification of the hardware for fault diagnosis itself, it is an object to improve diagnosis accuracy without increasing cost, by making the timing for executing fault diagnosis a suitable timing.

Moreover, it is an object to speed up execution of fault diagnosis and thus avoid beforehand, adverse affects on handling due to faults.

SUMMARY OF THE INVENTION

Therefore, with the present invention, with a fuel vapor treatment unit which temporarily adsorbs fuel vapor from a fuel tank of an internal combustion engine into an adsorption unit via a vapor passage, and then processes the fuel vapor by drawing this into an engine intake system from the adsorption unit under predetermined engine operating conditions, via a purge passage in which is disposed a purge control valve, the presence of a fault is diagnosed in the following manner.

A condition for close to engine start time is detected for example based on an ignition switch signal, or an engine rotation signal, and fault diagnosis of the fuel vapor treatment unit is permitted on the proviso that this condition is detected.

When the fault diagnosis is permitted, the purge control valve is closed, and air which is pressurized by a pump device, is supplied to inside the sealed fuel vapor treatment unit.

Then, when there is a fuel vapor leak (fault) in the fuel vapor treatment unit, the pressure inside the fuel vapor treatment unit is lowered in comparison with the pressure when there are no leaks. Therefore, by detecting the pressure condition, the presence of a fault can be diagnosed.

In this way, since fault diagnosis of the fuel vapor treatment unit is performed under the proviso that the engine condition is close to start time, the influence of heat from the engine after the engine has stopped, and the influence of vibration due to the road surface when the vehicle is travelling and of atmospheric pressure changes due to differences in altitude can be simultaneously avoided, so that erroneous diagnosis due to these influences can be prevented, and fault diagnosis accuracy thus improved.

Furthermore, by appropriately controlling the timing for executing fault diagnosis without requiring special modifications of the hardware for fault diagnosis, diagnosis accuracy can be improved without increasing cost.

Moreover, since diagnosis is executed when the engine condition is close to start time, adverse affects on handling due to faults can be avoided beforehand.

Furthermore, the construction may be such that a temperature condition inside the fuel vapor treatment unit is detected, and fault diagnosis of the fuel vapor treatment unit is permitted on the proviso that the interior of the fuel vapor treatment unit is detected to be a low temperature condition equal to or below a predetermined temperature.

That is to say, fault diagnosis of the fuel vapor treatment unit is permitted on the proviso that, in addition to the engine condition being close to start time, the interior of the fuel vapor treatment unit is a lower temperature condition equal to or below a predetermined temperature.

In this way, the influence of heat from the engine in the case such as at the time of high temperature restarting (hot restart time) can be avoided, and hence fault diagnosis accuracy can be further improved.

Furthermore, the construction may be such that for the temperature condition inside the fuel vapor treatment unit, at least one of fuel temperature, engine cooling water temperature, atmospheric temperature, and the temperature of the adsorbent inside the adsorption unit is detected.

In this way, by detecting for example the fuel temperature or the temperature of the adsorbent inside the adsorption unit, the temperature conditions inside the fuel vapor treatment unit can be detected in a high accuracy. Moreover, in the case where the detection value of the engine cooling water temperature, or the atmospheric temperature is used, a sensor such as the water temperature sensor or the intake air temperature sensor to be used for other control, can be appropriated, so that temperature conditions can be detected without increasing costs.

Moreover, fault diagnosis of the fuel vapor treatment unit may be permitted also on the proviso that a fuel quantity inside the fuel tank is within a predetermined range.

In this way, the volume of the air space inside the fuel vapor treatment unit at the time of fault diagnosis is limited. Therefore diagnosis time can be shortened, and erroneous judgment thus prevented.

Moreover, a time after starting power supply to a control circuit of the engine but before starting the engine, may be detected as a condition for close to engine start time.

That is to say, pre-start time after switching on the ignition switch to start power supply to the engine control circuit, and before switching on the starting switch, is detected as a condition for close to engine start time.

In this way, heating and agitation of the fuel inside the fuel tank, due to engine operation, can be prevented, so that fault diagnosis accuracy can be further improved.

Furthermore, in the case of performing diagnosis before starting the engine, fault diagnosis of the fuel vapor treatment unit may be permitted also on the proviso that there is no refueling.

In this way, erroneous judgment due to pressure changes following changes in the volume of the air space inside the fuel tank at the time of filling can be prevented.

Moreover, a time after starting power supply to the control circuit of the engine and immediately after starting the engine, may be detected as a condition for close to engine start time.

That is to say, the time after switching on the ignition switch to start power supply to the engine control circuit, and immediately after starting by operating the starter to crank the engine and cause detonation, is detected as a condition for close to engine start time.

In this way, fault diagnosis is performed while the engine is running after starting. Therefore power consumption prior to start can be prevented, and it will not take time for starting. Moreover, a proviso of a non filling time is automatically satisfied, and hence a filling sensor or the like become unnecessary.

Furthermore, the engine cranking time may be excluded from detection of a condition for close to engine start time.

That is to say, when the starter is operated to perform cranking, detection of a condition for close to engine start time is not made. Consequently fault diagnosis is not permitted.

In this way, an increase in battery load due to simultaneous operation of the starter and the pump device can be avoided.

Moreover, prior to supplying pressurized air to the inside of the fuel vapor treatment unit with the purge control valve closed, pressurized air may be supplied to the inside of the fuel vapor treatment unit with the purge control valve open to scavenge the interior of the fuel vapor treatment unit.

In this way, fuel vapor accumulated inside the fuel vapor treatment unit, for example when the vehicle is parked, is swept away, and after this has been replaced with fresh air from outside, the pressurized air is supplied to perform fault diagnosis. Therefore the influence of residual vapor pressure can be eliminated, and fault diagnosis accuracy thus improved.

Furthermore, the pump device may be an electric type, and the pressure condition inside the fuel vapor treatment unit may be detected from an operating current value of the pump device.

That is to say, when the pressure inside the fuel vapor treatment unit is high, the operating current value increases because of the heavy drive load on the electric pump device, while when the pressure is low due to the occurrence of a leak or the like, the operating current value decreases because of the low drive load. Hence the pressure condition inside the fuel vapor treatment unit can be detected based on the operating current value.

In this way, by detecting the operating current value of the electric pump device, the pressure change inside the fuel vapor treatment unit can be detected to a high accuracy. Hence there is no longer the need to provide a special pressure sensor and the fuel vapor treatment unit can be simplified.

Furthermore, a passage in which is disposed a reference orifice having a reference aperture diameter, and a passage switching valve may be provided in the fuel vapor treatment unit, and while switching the passage with the passage switching valve, the pressure condition inside the fuel vapor treatment unit may be detected by comparing the operating current value of the electric pump device when pressurized air is supplied to the inside of the fuel vapor treatment unit via a passage having a sufficiently larger bore diameter than the reference aperture diameter of the reference orifice, with an operating current value of the electric pump device when under the same conditions, pressurized air is supplied to only the passage in which the reference orifice is disposed.

In this way, when the operating current value of the electric pump device for when pressurized air is supplied to the inside of the fuel vapor treatment unit is less than the operating current value of the electric pump device for when pressurized air is supplied to only the passage in which the reference orifice is disposed, it can be diagnosed that the pressure condition inside the fuel vapor treatment unit is less than a reference condition, and that there is a leak. Hence diagnosis can be standardized so that diagnosis can be performed easily and to a high accuracy.

DESCRIPTION OF THE PREFERRED EMBODIMENTS

As follows is a description of embodiments of the present invention.

Figure 1:
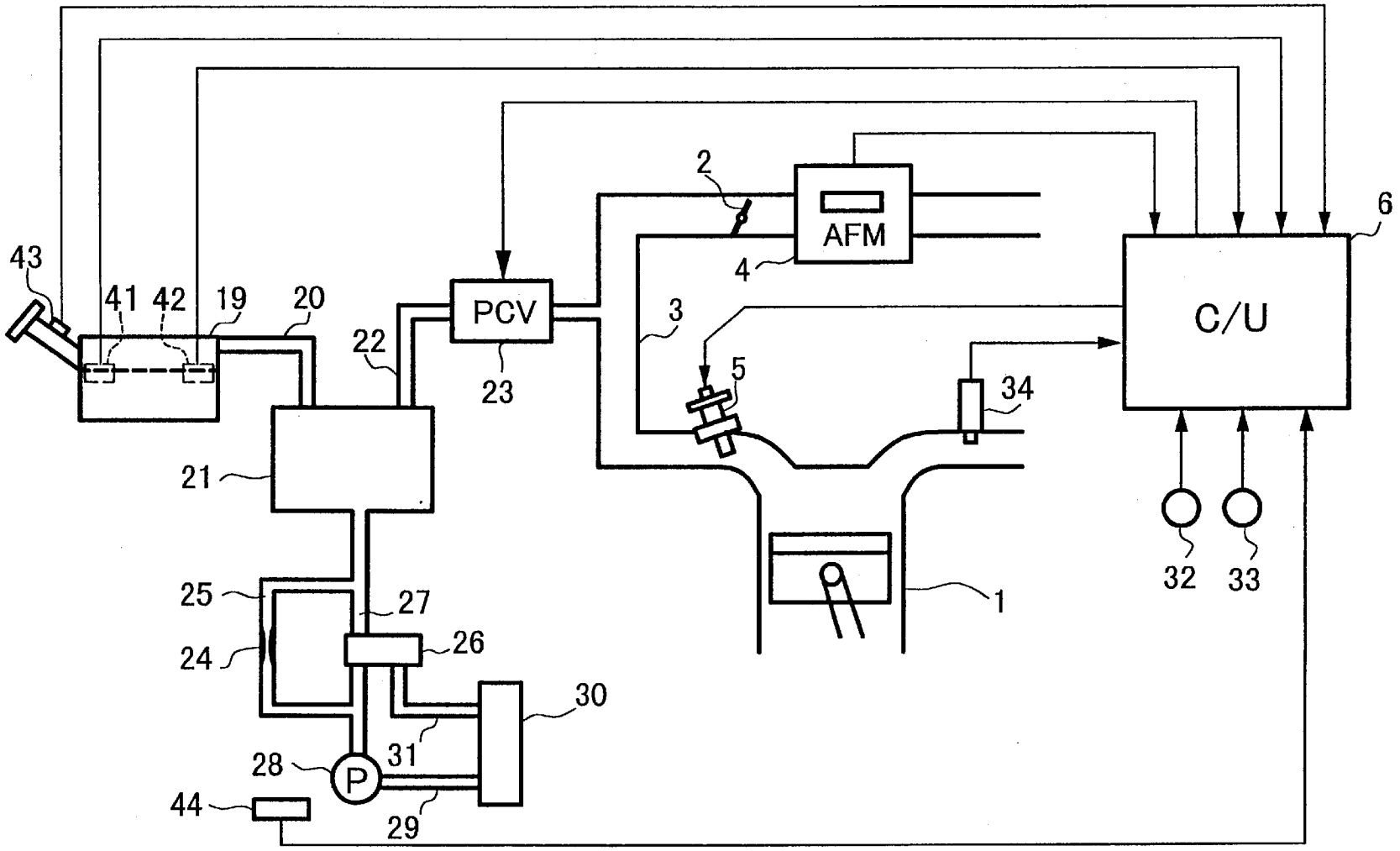
FIG. 1 is a block diagram showing a system configuration of an embodiment of a fault diagnosis apparatus of a fuel vapor treatment unit according to the present invention.

In FIG. 1 showing a first embodiment, air is drawn into an internal combustion engine 1 via an intake passage 3 in which is disposed a throttle valve 2 which is interlocked to an accelerator pedal (not shown in the figure) or driven by a motor such as a stepping motor or a DC motor.

An air flow meter 4 for detecting an intake air quantity which is flow controlled by the throttle valve 2, is disposed in an upstream section of the intake passage 3, and solenoid type fuel injection valves 5 are provided for each cylinder, in a downstream section (manifold section) of the intake passage 3, for injecting fuel pumped from a fuel pump (not shown in the figure) and controlled to a predetermined pressure by a pressure regulator, into the intake passage 3. Control of a fuel injection quantity from the fuel injection valve 5 is performed by a control unit 6 incorporating a microcomputer.

Furthermore, the engine 1 is provided with a fuel vapor treatment unit. The fuel vapor treatment unit adsorbs and collects fuel vapor generated in a fuel tank 19, in an adsorbent such as activated carbon filled into a canister 21 serving as an adsorption unit, by way of a purge passage 20. The fuel adsorbed in the adsorbent is then drawn into the intake passage 3 on the downstream side of the throttle valve 2 via a purge passage 22, at the time of predetermined operating conditions, and burnt.

In the purge passage 22 is disposed a solenoid operated purge control valve 23 which is controlled based on a control signal from the control unit 6.

For fault diagnosis (fuel vapor leak diagnosis) of the fuel vapor treatment unit, the following piping system is constructed. That is to say, an electric pump (pump device) 28 is connected to an air introduction port opened at a lower portion of the canister 21, by means of a first passage 25 in which is disposed a reference orifice 24 of a reference aperture diameter, for example 0.5 mm aperture diameter, and a second passage 27 connected in parallel with the first passage 25 by way of one port of a switching valve 26. An air introduction passage 29 connected to an intake port of the electric pump 28 introduces filtered air via an air filter 30. An air discharge passage 31 is connected to the other port of the switching valve 26.

Figure 2:
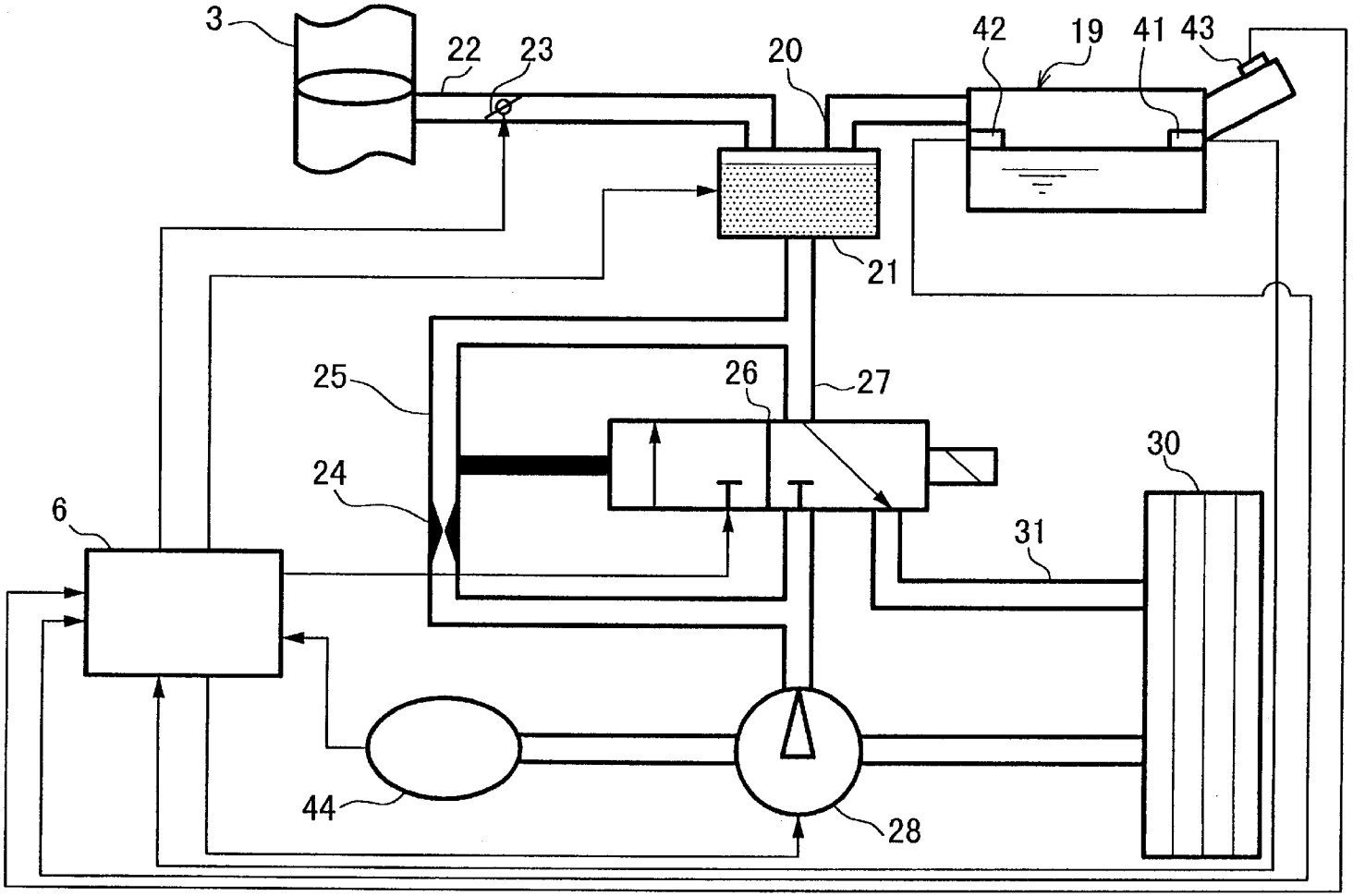
FIG. 2 is a diagram showing the construction of the main parts of the embodiment with a switching valve in a closed condition.

The switching valve 26 is constructed so that in a closed condition of the one port as shown in FIG. 2, the other port is communicated with the second passage 27 which reaches to the air introduction port of the canister 21, and pressurized air discharged from the electric pump 28 passes through the first passage 25 in which is disposed the reference orifice 24 and is supplied to the canister 21. Moreover one part of the air is returned to the switching valve 26 and discharged from the other port to the air discharge passage 31 and after being filtered by the air filter 30, is discharged to the atmosphere.

Figure 3:
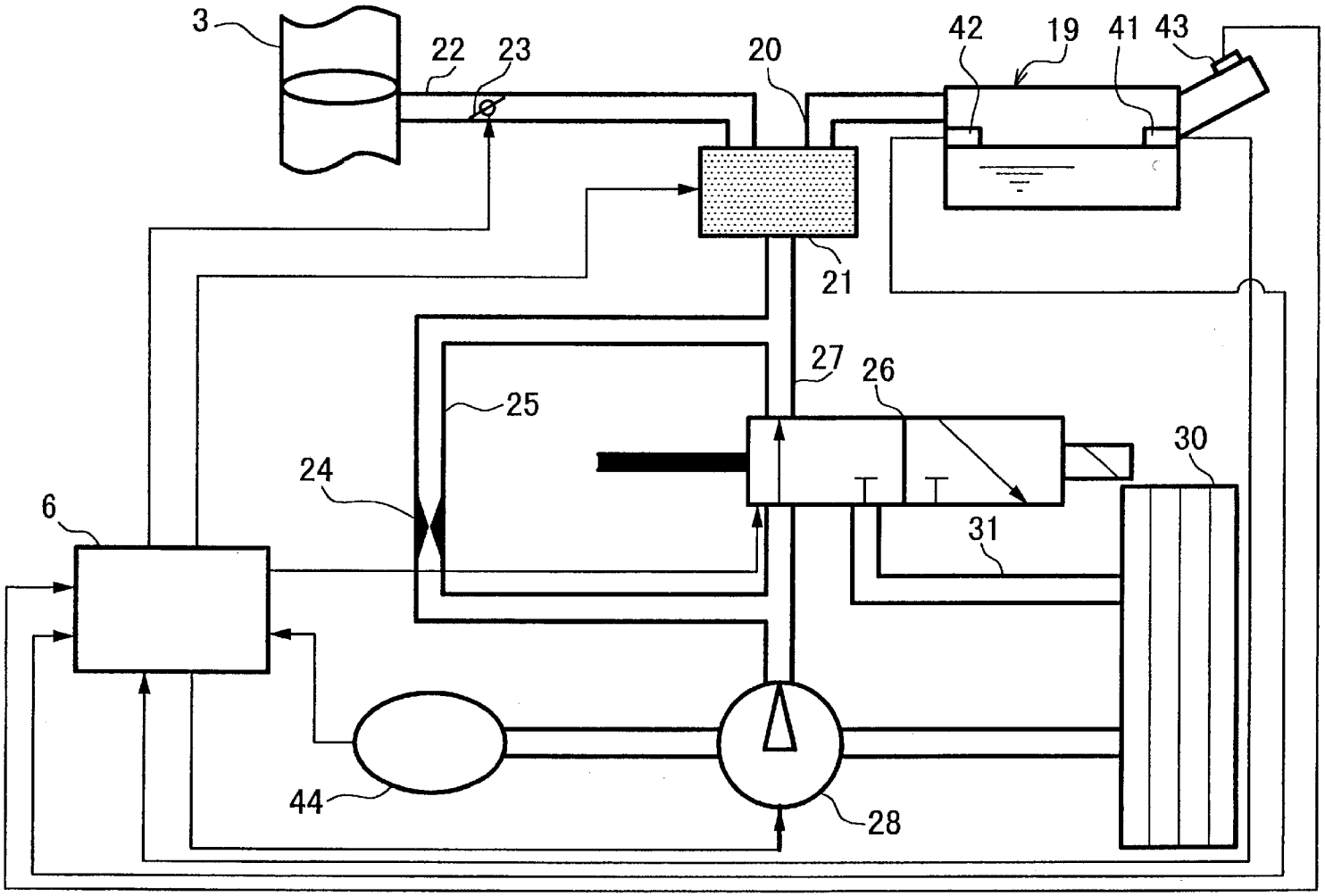
FIG. 3 is a diagram showing the configuration of the main parts of the embodiment with the switching valve in an open condition.

On the other hand, when the switching valve 26 is switched from the condition of FIG. 2 and moves to the right (in the figure), the one port as shown in FIG. 3 is opened, so that the pressurized air discharged from the electric pump 28 is supplied to the canister 21 with the majority passing along the second passage 27 via the one port, and a part passing along the first passage 25. Moreover, the other port is closed, so that discharge air is not discharged to the atmosphere via the air filter 30.

Furthermore, inside the fuel tank 19 is fitted a temperature sensor 41 and a fuel quantity sensor 42 which detect the fuel temperature and fuel quantity. Moreover a fill sensor 43 is fitted for detecting an open condition of a filler cap as a filling condition. A current detector 44 is connected to the electric pump 28 for detecting the operating current value thereof. By detecting this operating current, the pressure condition inside the fuel vapor treatment unit is detected (hence, the current detector 44 corresponds to the pressure condition detection device), and consequently the presence of a fault of the fuel vapor treatment unit is judged.

In addition, there is provided a rotational speed sensor 32 for detecting an engine rotational speed N, a water temperature sensor 33 for detecting water temperature Tw, and an air-fuel ratio sensor 34 for detecting air-fuel ratio based for example on oxygen concentration in the exhaust. Detection signals from these sensors are output to the control unit 6.

The control unit 6 controls the fuel injection quantity from the fuel injection valves 5, based on signals from the respective sensors to thereby effect air-fuel ratio feedback control, and under predetermined operating conditions, controls the purge control valve 23 to effect processing for purging the fuel vapor into the intake system, and under predetermined conditions diagnoses faults of the fuel vapor treatment unit according to the present invention.

With this construction, a fault diagnosis routine for the fuel vapor treatment unit executed by the control unit 6 will now be explained following the flow chart of FIG. 4. This routine is started concurrently with the driver switching on the ignition switch to supply power to the engine control circuit.

In step 100 (with this abbreviated to S100 in the figures with other steps similarly abbreviated), the various operating conditions detected by the various sensors are read in.

In step 101, based on the various read in operating conditions it is judged if predetermined fault diagnosis start conditions, for example the following conditions, have been satisfied.

A. The engine rotational speed detected by the rotational speed sensor 32 is less than a predetermined value and the engine is in a stopped condition before starting (this can also prevent the surface of the fuel inside the fuel tank from being agitated due not only to travelling vibration but also to engine vibration from engine operation. Moreover, since there is no heat due to engine operation, this can prevent a rise in fuel temperature. Furthermore, fluctuations in atmospheric pressure due to travelling along roads of different altitude can be avoided). The function of permitting a later described fault diagnosis on the proviso that at least the conditions of A are satisfied, corresponds to a fault diagnosis permit device or means.

B. The fuel temperature detected by the temperature sensor 41 is equal to or less than a predetermined value (the fuel vapor inside the fuel tank 19 is not generated in large quantities and the pressure inside the fuel vapor treatment unit does not rise. The temperature of the adsorbent inside the canister 21 or the temperature of the fuel vapor inside the purge passage 20 may be used).

C. The fuel quantity detected by the fuel quantity sensor 42 is within a predetermined range (this shortens the diagnosis time and also prevents erroneous judgment. With the present embodiment, this is a range of 40 to 75 with a full tank as 100).

D. There is no filling based on a detection signal from the filling sensor 43 (this is to prevent erroneous judgment).

E. Fault judgment of the fault diagnosis apparatus (purge control valve etc.) according to the present invention has not been made.

When all the above diagnosis conditions are met, control proceeds to step 102, while when at least one is not met, control returns to step 100. Here, of the abovementioned conditions A~E , A is an essential condition of the first embodiment (the judgment function for this condition corresponds to a start time vicinity detection device or means). B also is a condition which should be included as much as possible. While it is also desirable to meet the conditions of C~E, for simplicity, any of these may be omitted.

In step 102, processing is performed for initializing the atmosphere inside the fuel vapor treatment unit. More specifically, the purge control valve 23 is opened, the one port of the switching valve 26 is closed, and the other port opened, and the electric pump 28 operated. These conditions are then maintained for a predetermined time by the judgment of step 103.

Figure 5:
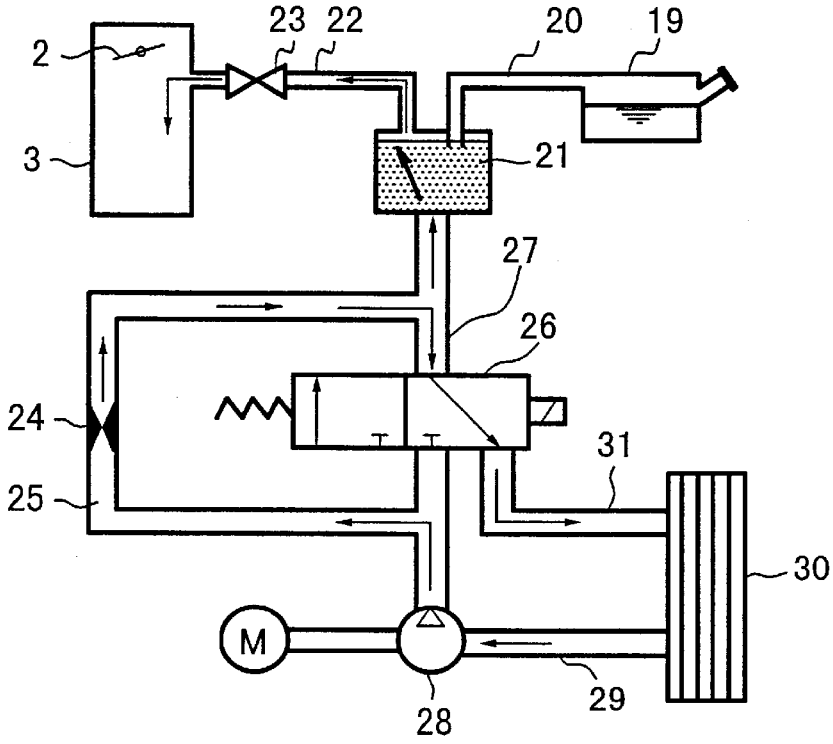
FIG. 5 is a diagram showing the flow of air at the time of executing initialization processing in the embodiment.

At this time, as shown in FIG. 5, due to operation of the electric pump 28, air introduced via the air filter 30 and the air introduction passage 29 passes via the first passage 25 through the canister 21 and is flown into the intake passage 3 via the purge passage 22. Furthermore, a part of the air passes from the switching valve 26 via the air discharge passage 31 and the air filter 30 and is discharged into the atmosphere.

As a result, the residual pressure (negative pressure) and residual gas inside the fuel vapor treatment unit is eliminated. The predetermined time is set beforehand to enable supply by the electric pump 28 of fresh air from outside to the inside of the fuel vapor treatment unit via the air filter 30, and completely replace the old air inside the fuel vapor treatment unit with the introduced new air. With the fault diagnosis of the present invention, it is necessary to appropriately maintain the fuel vapor treatment unit internal pressure condition to be measured at the time of diagnosis. Therefore, in step 102 and step 103, the fuel vapor remaining inside the fuel vapor treatment unit while parked, is swept out and replaced with fresh outside air, giving appropriate atmosphere conditions. Moreover, this obviates the need for correction for the vapor generation quantity, and hence fault diagnosis can be easily made with good accuracy.

Figure 6:
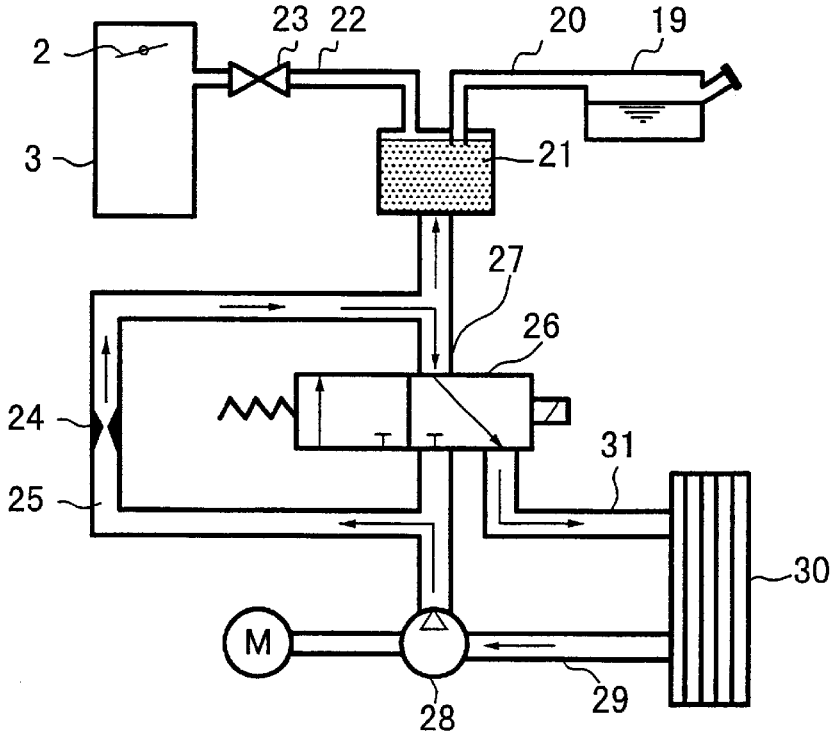
FIG. 6 is a diagram showing the flow of air at the time of setting a judgment level for the embodiment.

After the predetermined time lapse in step 103, control proceeds to step 104 where the purge control valve 23 is closed. As a result, as shown in FIG. 6, the air supplied from the electric pump 28 passes through the reference orifice 24 and is supplied to the inside of the fuel vapor treatment unit. Moreover, one part of the air returns to the switching valve 26 and is discharged to the atmosphere from the air filter 30.

Then in step 105, the lapse of a predetermined time is judged while maintaining the conditions of step 104. Consequently, when the air supplied from the electric pump 28 passes through the reference orifice 24 and is fed to the fuel vapor treatment unit, the pressure inside the fuel vapor treatment unit rises. When the pressure inside the fuel vapor treatment unit rises to a predetermined value and the air quantity supplied from the electric pump 28 equals the air quantity passing through the reference orifice 24 and returning to the switching valve 26 and then being led to the air filter 30, the load on the electric pump 28 becomes only that for passing air supplied by the electric pump 28 through the reference orifice 24. By detecting the operating current flowing in the electric pump 28 at this time, a later described reference slice level can be detected.

In step 106, the pump current detector 44 detects the operating current value of the electric pump 28, and outputs this to the control unit 6, after which control proceeds to step 107. The operating current value is the aforementioned reference slice level, and shows a negative condition when the 0.5 mm diameter reference orifice 24 passes air supplied from the electric pump 28 therethrough.

Figure 7:
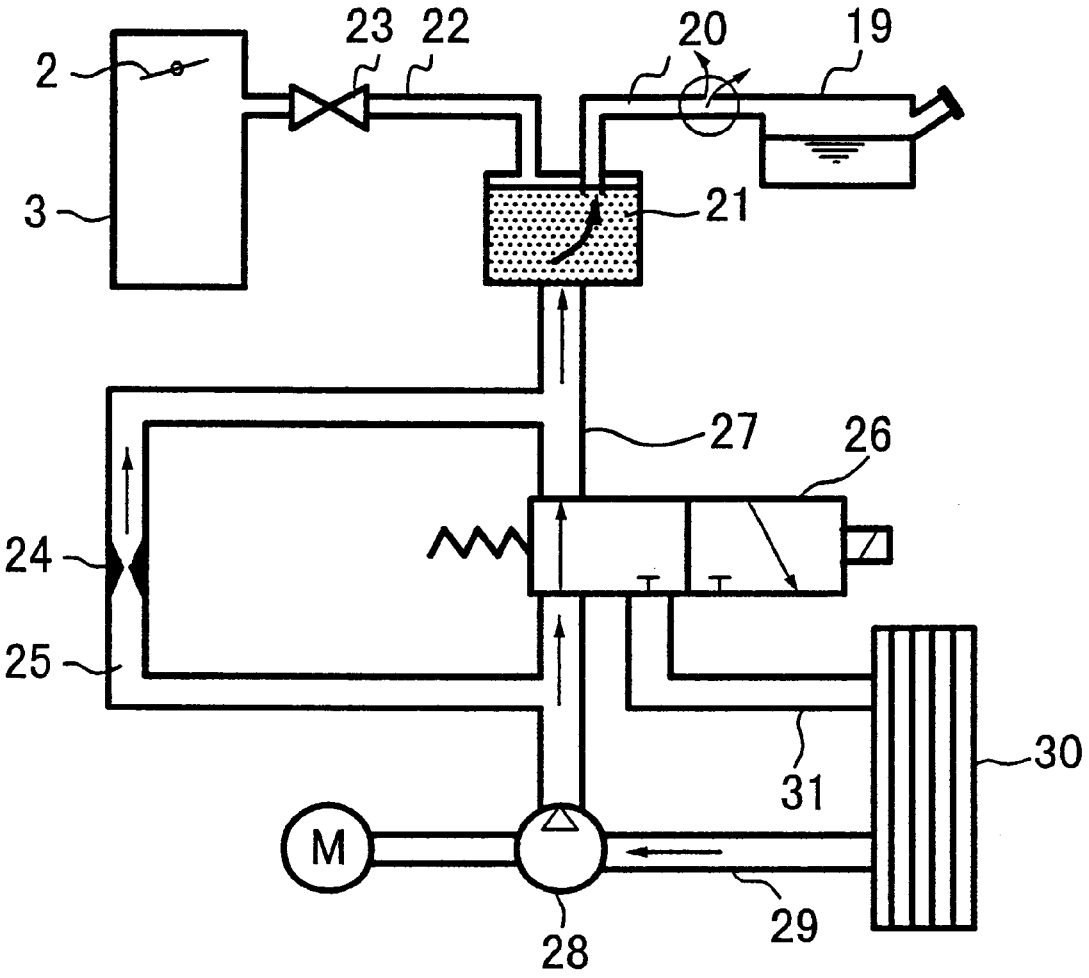
FIG. 7 is a diagram showing the flow of air at the time of executing a fault diagnostic test for the embodiment.

In step 107, the switching valve 26 is switched to the open side as shown in FIG. 7, and air supplied from the electric pump 28 is supplied directly to the inside of the fuel vapor treatment unit. On the other hand, the discharge passage to outside is shut off so that the pressure inside the fuel vapor treatment unit rises.

Then in step 108, the lapse of a predetermined time is judged. This predetermined time is the time necessary, in the case where there is no fault in the fuel vapor treatment unit, for the pressure inside the fuel vapor treatment unit to rise to a predetermined value by means of step 107. The condition is maintained until the predetermined time has elapsed, and after lapse of the predetermined time, control proceeds to step 109.

In step 109, the pump current detector 44 detects the operating current of the electric pump 28, and outputs this to the control unit 6, after which control proceeds to step 110. This operating current value represents the pressure inside the fuel vapor treatment unit, and becomes a test slice level.

In step 110, the reference slice level detected in step 106, and the test slice level detected in step 109 are compared with each other. That is to say, if there is no fault (leak) inside the fuel vapor treatment unit, the air supplied from the electric pump 28 does not leak to the outside and hence the pressure inside the fuel vapor treatment unit rises indicating a higher value than the reference slice level. In the case where there is a fault inside the fuel vapor treatment unit, the air supplied from the electric pump 28 leaks to the outside and hence the pressure inside the fuel vapor treatment unit does not rise. Hence the load on the electric pump 28 is reduced, indicating a value less than the reference slice level.

In the above manner, fault judgment is performed depending on the size of the test slice level with respect to the reference slice level. In the case where the test slice level is greater than the reference slice level and it is thus judged that there is no fault, control proceeds to step 111 giving a normal judgment, and the fault diagnosis is terminated.

Moreover, in the case where the test slice level is less than the reference slice level so that a fault is judged, control proceeds to step 112 to give an abnormal judgment. Then in step 113, a warning light is switched on, and a signal output to some other fail safe system, thereby advising of an abnormality in the fuel vapor treatment unit. In the above, the functions of step 104 through step 112 corresponds in essence to the fault diagnosis device or means.

Next is a description of a second embodiment of the present invention.

The construction of the hardware is the same as for the first embodiment except that there is no need to provide the fill sensor 43. Description is given using the reference symbols shown in FIG. 2.

Figure 8A:
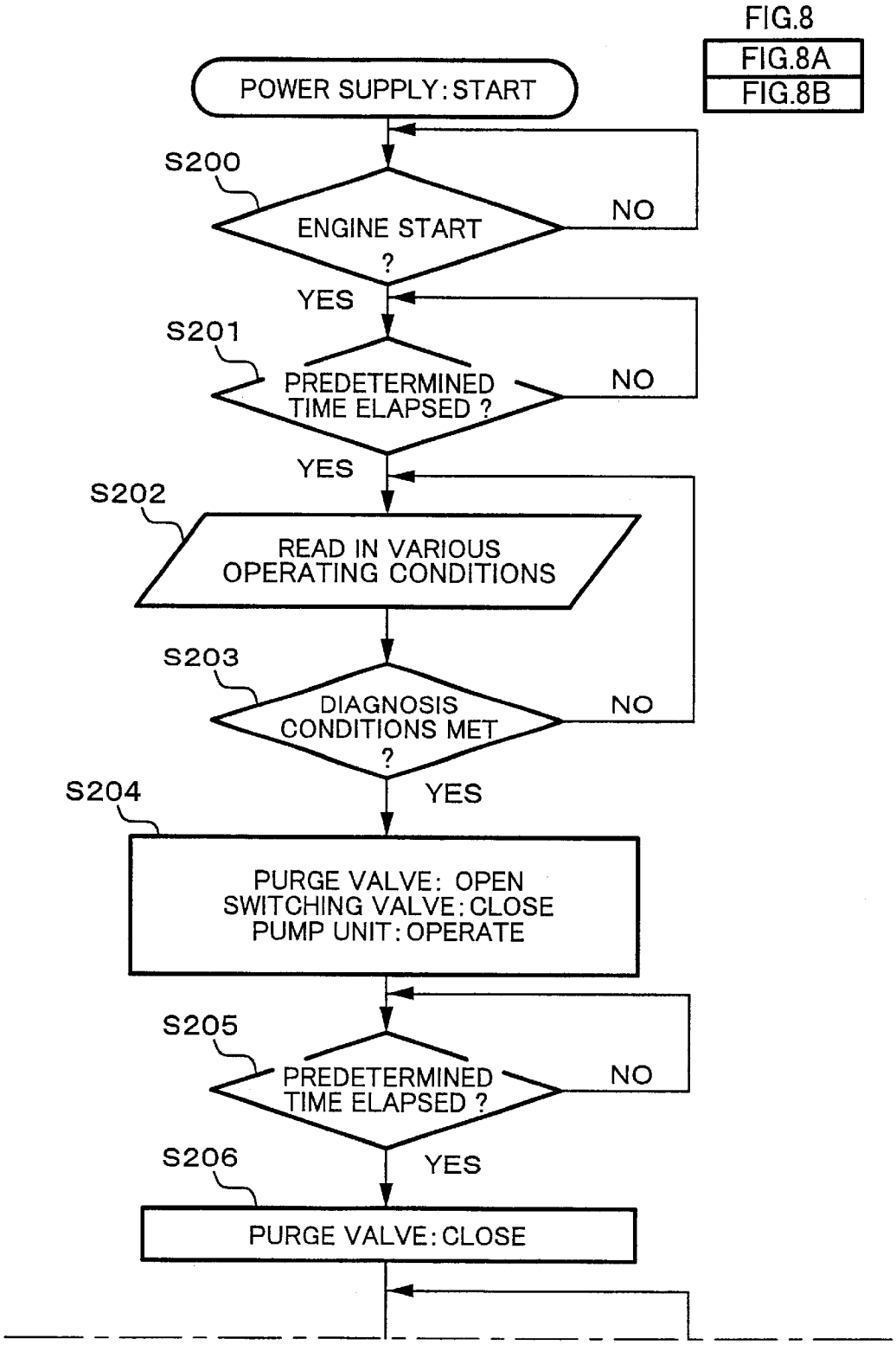
FIG. 8 is a flow chart showing a second embodiment of a fault diagnosis routine.
Figure 8B:
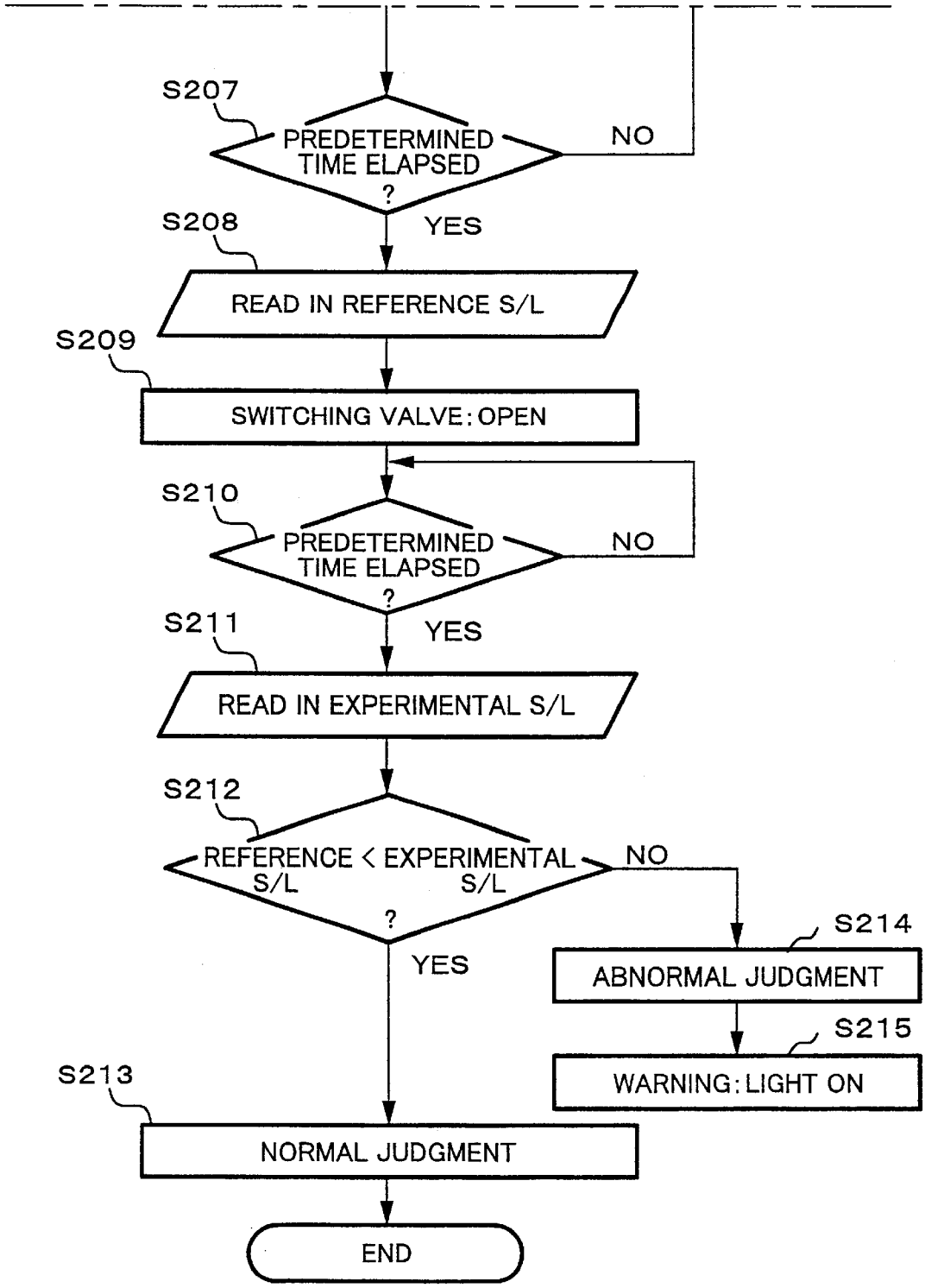

The fault diagnosis routine of the fuel vapor treatment unit of the second embodiment will be explained following the flow chart of FIG. 8. This routine is also started concurrently with the driver switching on the ignition switch to supply power to the engine control circuit.

In step 200, engine start judgment is made. When based on the detection value of the rotational speed sensor 32 it is judged that the engine has started (detonation), control proceeds to step 201 where it is judged if a predetermined time has elapsed. The function of step 201 corresponds to the start time vicinity detection means. The function for permitting fault diagnosis when the engine start is judged, corresponds to the fault diagnosis permit device or means.

After the predetermined time lapse in step 201, engine operating conditions are stabilized so that purging of the canister 21 can be adequately performed. By performing fault diagnosis when the residual quantity of fuel vapor inside the canister 21 has been sufficiently reduced, over richening due to the flow of fuel vapor to the inside of the intake passage 3 at the time of fault diagnosis does not occur, and hence deterioration in driveability and emissions can be prevented.

When after the predetermined time lapse in step 201 control proceeds to step 202, the various operating conditions detected by the beforementioned sensors are read in.

In step 203, based on the various operating conditions which have been read in, it is judged if predetermined fault diagnosis start conditions, such as the below mentioned conditions, have been satisfied.

Fuel temperature is equal to or less than a predetermined value.

Fuel quantity is within a predetermined range.

Fault judgment of the fault diagnosis apparatus of the present invention has not been made.

The above three conditions are the same as for the first embodiment.

When all of the abovementioned diagnosis conditions are met, control proceeds to step 204, while in the case where the diagnosis conditions are not met, control returns and repeats from step 202. In the second embodiment, although a time immediately after starting the engine judged in step 200 is an essential condition, for simplification, any of the various diagnosis conditions in step 203 may be omitted.

Figure 4A:
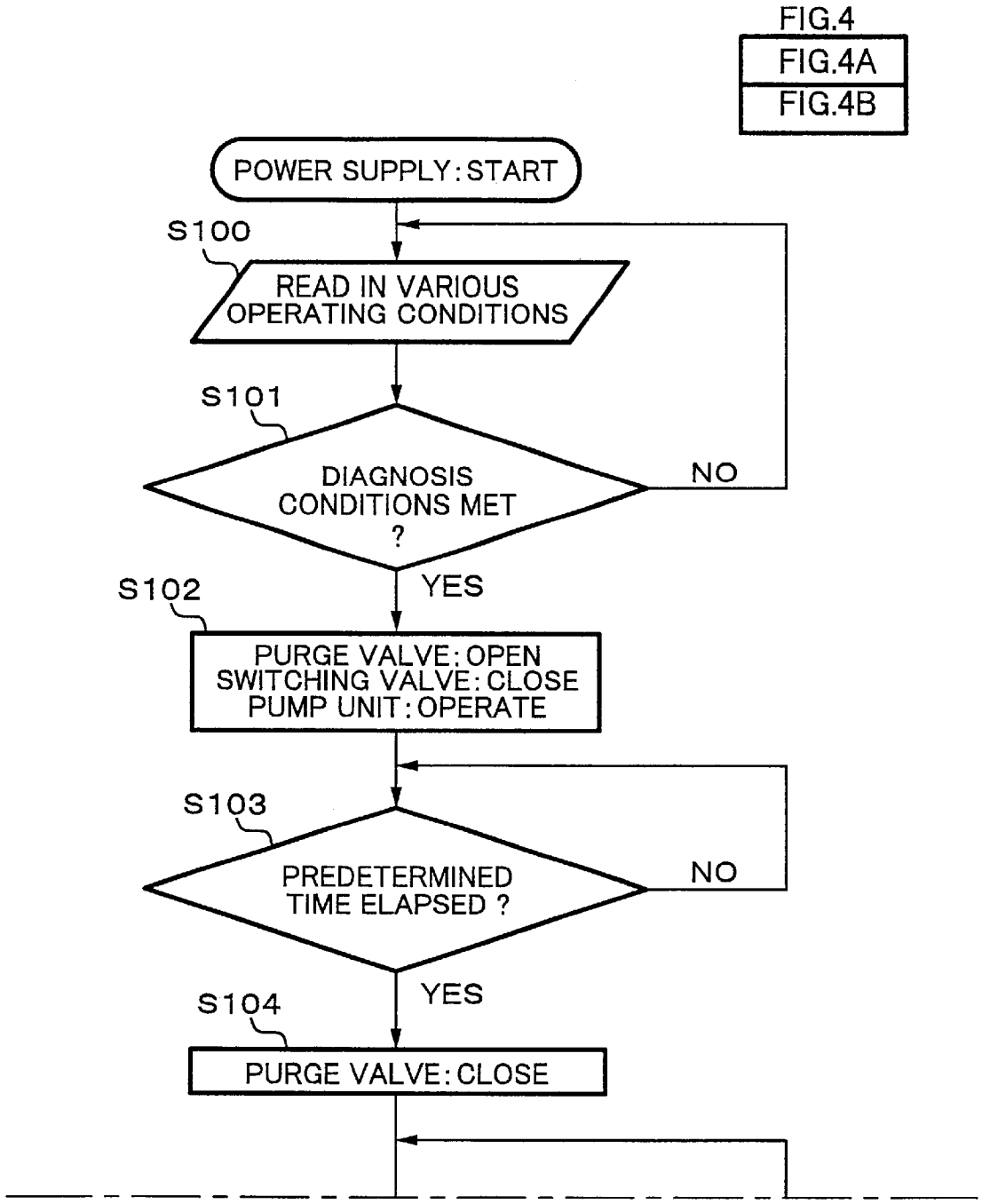
FIG. 4 is a flow chart showing a first embodiment of a fault diagnosis routine.
Figure 4B:
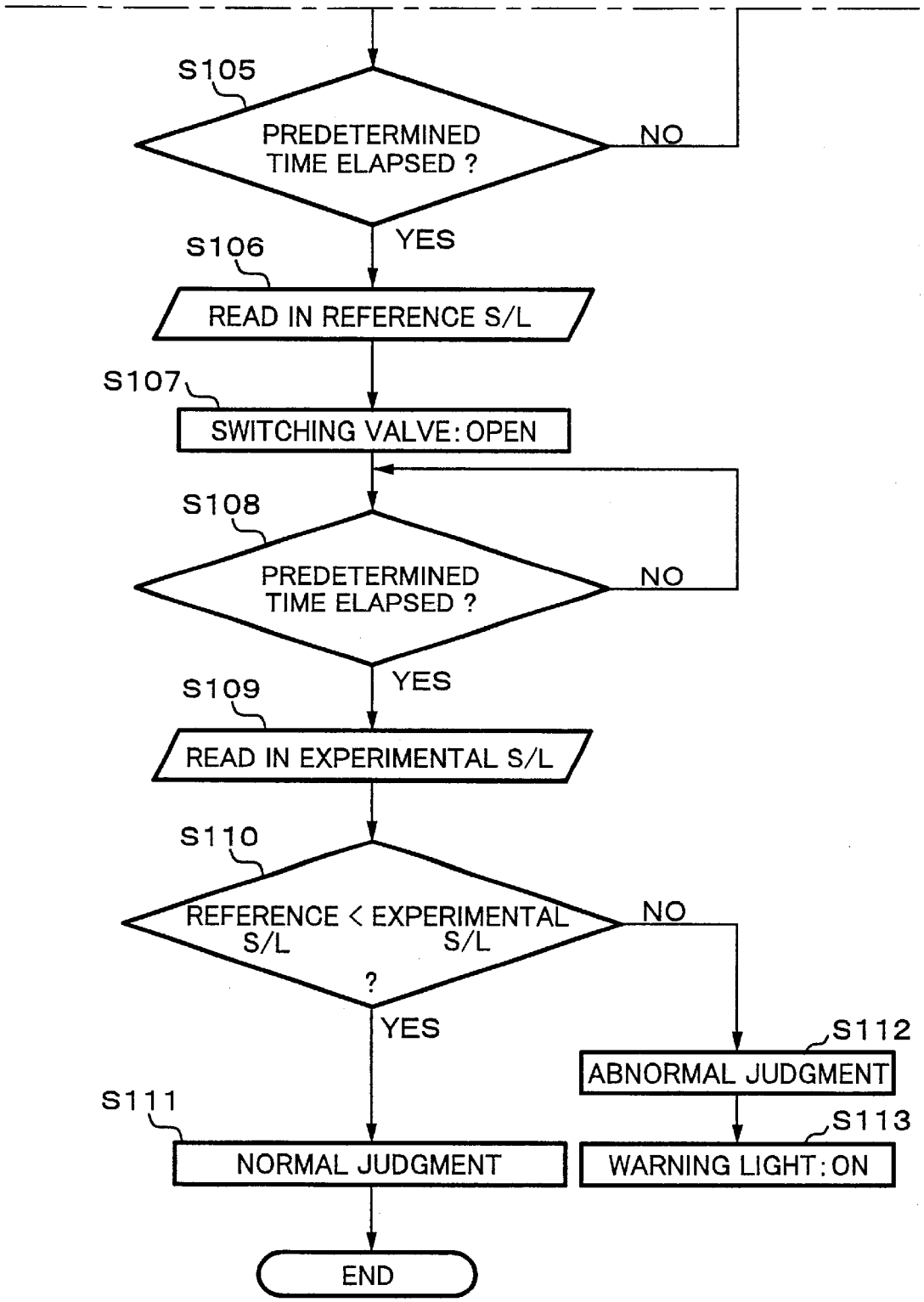

The processing of step 204 and thereafter is the same as the processing of step 102 and thereafter for the first embodiment of FIG. 4. The functions of step 206 through step 214 essentially correspond to the fault diagnosis device or means.

In this way, with the second embodiment, as with the first embodiment, the situation where the fuel surface inside the fuel tank is agitated due to travelling vibration can be prevented, and since fault diagnosis is made immediately after starting the engine, the rise in fuel temperature due to heat from the engine can be reduced. Furthermore, since any travelling distance will be short, fluctuations in atmospheric pressure due to travelling along roads of different altitude can be avoided. Moreover, by performing fault diagnosis immediately after starting the engine, the load on the battery can be reduced, and the engine starting is not delayed due to diagnosis. Furthermore since fault diagnosis is not performed during filling, the diagnosis apparatus can be simplified without providing a refueling sensor.

The present invention is not limited to the above embodiments.

What I claimed are:

1. A method of diagnosing faults of a fuel vapor treatment unit which temporarily adsorbs fuel vapor from a fuel tank of an internal combustion engine into an adsorption unit via a vapor passage, and then processes the fuel vapor by drawing this into an engine intake system from said adsorption unit under predetermined engine operating conditions, via a purge passage in which is disposed a purge control valve, comprising:

detecting if said engine is in a condition for close to start time;

permitting diagnosis for the presence of a fault of said fuel vapor treatment unit on the proviso that a condition for close to engine start time is detected, closing said purge control valve, and supplying pressurized air to the inside of said fuel vapor treatment unit when said diagnosis is permitted, detecting a pressure condition inside said fuel vapor treatment unit after supplying said pressurized air, and diagnosing the presence of a fault of said fuel vapor treatment unit based on said detected pressure condition.

2. A method of diagnosing faults of a fuel vapor treatment unit according to claim 1, further comprising the step of detecting a temperature condition inside said fuel vapor treatment unit, wherein fault diagnosis of said fuel vapor treatment unit is permitted on the proviso that the interior of said fuel vapor treatment unit is detected to be a low temperature condition equal to or below a predetermined temperature.

3. A method of diagnosing faults of a fuel vapor treatment unit according to claim 2, wherein the temperature condition inside said fuel vapor treatment unit is detected by detecting at least one of fuel temperature, engine cooling water temperature, atmospheric temperature, and the temperature of an adsorbent inside the adsorption unit.

4. A method of diagnosing faults of a fuel vapor treatment unit according to claim 1, wherein fault diagnosis of said fuel vapor treatment unit is permitted also on the proviso that a fuel quantity inside said fuel tank is within a predetermined range.

5. A method of diagnosing faults of a fuel vapor treatment unit according to claim 1, wherein a time after starting power supply to a control circuit of the engine and before starting the engine, is detected as a condition for close to engine start time.

6. A method of diagnosing faults of a fuel vapor treatment unit according to claim 5, wherein fault diagnosis of said fuel vapor treatment unit is permitted also on the proviso that there is no filling.

7. A method of diagnosing faults of a fuel vapor treatment unit according to claim 1, wherein a time after starting power supply to a control circuit of the engine and immediately after starting the engine, is detected as a condition for close to engine start time.

8. A method of diagnosing faults of a fuel vapor treatment unit according to claim 1, wherein engine cranking time is excluded from detection of a condition for close to engine start time.

9. A method of diagnosing faults of a fuel vapor treatment unit according to claim 1, wherein prior to supplying pressurized air to the inside of said fuel vapor treatment unit with said purge control valve closed, pressurized air is supplied to the inside of said fuel vapor treatment unit with said purge control valve open to scavenge the interior of said fuel vapor treatment unit.

10. A method of diagnosing faults of a fuel vapor treatment unit according to claim 1, wherein supply of pressurized air to said fuel vapor treatment unit is performed by an electric pump device, and the pressure condition inside said fuel vapor treatment unit is detected from an operating current value of said pump device.

11. A method of diagnosing faults of a fuel vapor treatment unit according to claim 10, wherein the pressure condition inside said fuel vapor treatment unit is detected by comparing an operating current value of the electric pump device when pressurized air is supplied to the inside of said fuel vapor treatment unit, with an operating current value of the electric pump device when under the same conditions, pressurized air is supplied to a passage in which a reference orifice having a reference aperture diameter is disposed.

12. An apparatus for diagnosing faults of a fuel vapor treatment unit comprising:

said fuel vapor treatment unit which temporarily adsorbs fuel vapor from a fuel tank of an internal combustion engine into an adsorption unit via a vapor passage, and then processes the fuel vapor by drawing this into an engine intake system from said adsorption unit under predetermined engine operating conditions, via a purge passage in which is disposed a purge control valve;

a pump device for supplying pressurized air to the inside of said fuel vapor treatment unit;

a pressure condition detection device for detecting a pressure condition inside said fuel vapor treatment unit;

a start time vicinity detection device for detecting a condition for close to engine start time;

a fault diagnosis permit device for permitting fault diagnosis of said fuel vapor treatment unit on the proviso that conditions for close to engine start time are detected by said start time vicinity detection device; and a fault diagnosis device for closing said purge control valve, and supplying pressurized air to the inside of said fuel vapor treatment unit by said pump device when said diagnosis is permitted by said fault diagnosis permit device, to raise the pressure inside said fuel vapor treatment unit, and then diagnosing the presence of a fault of said fuel vapor treatment unit based on a pressure condition inside said fuel vapor treatment unit detected by said pressure condition detection device.

13. An apparatus for diagnosing faults of a fuel vapor treatment unit according to claim 12, further comprising a temperature condition detection device for detecting a temperature condition inside said fuel vapor treatment unit, wherein said fault diagnosis permit device permits fault diagnosis of said fuel vapor treatment unit also on the proviso that the interior of said fuel vapor treatment unit is detected by said temperature condition detection device to be a low temperature condition equal to or below a predetermined temperature.

14. An apparatus for diagnosing faults of a fuel vapor treatment unit according to claim 13, wherein said temperature condition detection device detects the temperature condition inside said fuel vapor treatment unit by detecting at least one of fuel temperature, engine cooling water temperature, atmospheric temperature, and the temperature of an adsorbent inside the adsorption unit.

15. An apparatus for diagnosing faults of a fuel vapor treatment unit according to claim 12, further comprising a device for detecting a fuel quantity inside said fuel tank, wherein said fault diagnosis permit device permits fault diagnosis of said fuel vapor treatment unit also on the proviso that a fuel quantity inside said fuel tank is within a predetermined range.

16. An apparatus for diagnosing faults of a fuel vapor treatment unit according to claim 12, wherein said start time vicinity detection device detects a time after starting power supply to a control circuit of the engine and before starting the engine, as a condition for close to engine start time.

17. An apparatus for diagnosing faults of a fuel vapor treatment unit according to claim 16, further comprising a device for detecting a filling condition, wherein said fault diagnosis permit device permits fault diagnosis of said fuel vapor treatment unit also on the proviso that there is no filling.

18. An apparatus for diagnosing faults of a fuel vapor treatment unit according to claim 12, wherein said start time vicinity detection device detects a time after starting power supply to a control circuit of the engine and immediately after starting the engine as a condition for close to engine start time.

19. An apparatus for diagnosing faults of a fuel vapor treatment unit according to claim 12, wherein with said start time vicinity detection device, engine cranking time is excluded from detection of a condition for close to engine start time.

20. An apparatus for diagnosing faults of a fuel vapor treatment unit according to claim 12, wherein said fault diagnosis device, prior to supplying pressurized air to the inside of said fuel vapor treatment unit with said purge control valve closed, supplies pressurized air to the inside of said fuel vapor treatment unit with said purge control valve open to scavenge the interior of said fuel vapor treatment unit.

21. An apparatus for diagnosing faults of a fuel vapor treatment unit according to claim 12, wherein said pump device is an electric type, and said pressure condition detection device comprises a current detection circuit for detecting an operating current value of said pump device, and the pressure condition inside said fuel vapor treatment unit is detected from said operating current value.

22. A fault diagnosis apparatus for a fuel vapor treatment unit according to claim 21, wherein said fuel vapor treatment unit comprises a passage in which is disposed a reference orifice having a reference aperture diameter, and a passage switching valve, and while switching the passage with said passage switching valve, said pressure condition detection device detects the pressure condition inside said fuel vapor treatment unit by comparing an operating current value of the electric pump device when pressurized air is supplied to the inside of said fuel vapor treatment unit via a passage with a sufficiently larger bore diameter than the reference orifice diameter, with an operating current value of the electric pump device when under the same conditions, pressurized air is supplied to only the passage in which the reference orifice is disposed.

23. An apparatus for diagnosing faults of a fuel vapor treatment unit comprising:

said fuel vapor treatment unit which temporarily adsorbs fuel vapor from a fuel tank of an internal combustion engine into an adsorption unit via a vapor passage, and then processes the fuel vapor by drawing this into an engine intake system from said adsorption unit under predetermined engine operating conditions, via a purge passage in which is disposed a purge control valve;

pressurized air supply means for supplying pressurized air to the inside of said fuel vapor treatment unit;

pressure condition detection means for detecting a pressure condition inside said fuel vapor treatment unit;

start time vicinity detection means for detecting a condition for close to engine start time;

fault diagnosis permit means for permitting fault diagnosis of said fuel vapor treatment unit on the proviso that conditions for close to engine start time are detected by said start time vicinity detection means; and fault diagnosis means for closing said purge control valve, and supplying pressurized air to the inside of said fuel vapor treatment unit by said pressurized air supply means when said diagnosis is permitted by said fault diagnosis permit means, to raise the pressure inside said fuel vapor treatment unit, and then diagnosing the presence of a fault of said fuel vapor treatment unit based on a pressure condition inside said fuel vapor treatment unit detected by said pressure condition detection means.

* * * * *